US005146550A

United States Patent [19]

Furter et al.

[11] Patent Number: 5,146,550

[45] Date of Patent: Sep. 8, 1992

[54] PROCESS FOR DISPLAYING MEASURING RESULTS IN GRAPHIC FORM IN TEST APPARATUS FOR TESTING TEXTILE GOODS AND APPARATUS FOR CARRYING OUT THE PROCESS

[75] Inventors: Richard Furter, Zug; Benno Christen, Winterthur, both of Switzerland

[73] Assignee: Zellweger Uster Ltd., Switzerland

[21] Appl. No.: 731,266

[22] Filed: Jul. 17, 1991

Related U.S. Application Data

[63] Continuation of Ser. No. 52,410, May 21, 1987, abandoned.

[30] Foreign Application Priority Data

May 21, 1986 [CH] Switzerland ..... 02043/86

[51] Int. Cl.[5] ..... G06F 15/46

[52] U.S. Cl. ..... 395/140; 364/470; 364/552; 73/160

[58] Field of Search ..... 73/159, 160; 340/677; 364/470, 469, 552, 554, 563, 522, 518; 395/140, 161, 119

[56] References Cited

U.S. PATENT DOCUMENTS

| | | | |
|---|---|---|---|
| 4,189,841 | 2/1980 | Loepfe | 73/160 X |
| 4,430,720 | 2/1984 | Aemmer | 364/552 |
| 4,481,820 | 11/1984 | Thomann | 73/160 X |
| 4,491,831 | 1/1985 | Sakai et al. | 340/677 |
| 4,537,202 | 8/1985 | Mancini et al. | 128/712 |
| 4,648,054 | 3/1987 | Farah et al. | 364/552 |
| 4,656,465 | 4/1987 | Erni et al. | 364/470 X |
| 4,758,968 | 7/1988 | Lord | 364/552 |

FOREIGN PATENT DOCUMENTS

| | | |
|---|---|---|
| 3230754 | 3/1983 | Fed. Rep. of Germany . |
| 3303770 | 12/1983 | Fed. Rep. of Germany . |

OTHER PUBLICATIONS

"Uster Tester I Model B" Information Brochure PE 452, 1980.

"Uster News Bulletin", Customer Information Brochure No. 28, Jul. 1980.

Patent Abstracts of Japan, vol. 8, No. 23 (P-251) (1460) Jan. 31, 1984; abstract of Japan Patent Publication JP-A-58-180 911.

"Rechnergesteverte Zugprüfgeräte" from Jan. 1984, Textilpraxis, pp. 38-40.

Keisokki brochure on KET-80B, 1982, in German and English.

Keisokki Report, ITMA 83 Issue, Oct. 1983, 4 pages.

Keisokki Report, No. 2, Sep. 1985, 4 pages.

Testechno literature piece "TESTCONTROL-Analge", 1 page, 1982.

Article "TESTCONTROL 85" said to have been published Oct. 1982, 3 pages.

Article "QUALITÄTSKONTROLLE/Etikettierung" from Jul. 1984, Mittex, pp. 259-262.

Booklet "Strength and Elongation Testing . . . " by Furter, 1985, pp. 45-52.

*Primary Examiner*—Gary V. Harkcom

*Assistant Examiner*—Raymond J. Bayerl

*Attorney, Agent, or Firm*—Burns, Doane, Swecker & Mathis

[57] ABSTRACT

A number of individual samples from a batch of textile material are tested in the form of a test series. During each test series, at least one type of data obtained for each individual sample is stored digitally, and after n individual samples have been tested this data is displayed in the form of a collective chart containing n suitably arranged individual curves. This type of display does away with the use of a chart recorder with its known disadvantages and enables a printer to be used. Also, since the data can be displayed in the form of a collective chart, pauses between individual measurements, which would otherwise occur due to the relatively low printing speed of the printer, and which would greatly reduce the output of the test installation, do not occur.

24 Claims, 5 Drawing Sheets

PROCESS FOR DISPLAYING MEASURING RESULTS IN GRAPHIC FORM IN TEST APPARATUS FOR TESTING TEXTILE GOODS AND APPARATUS FOR CARRYING OUT THE PROCESS

This application is a continuation of application Ser. No. 07/052,410, filed May 21, 1987, now abandoned which is hereby incorporated by reference.

BACKGROUND

This invention relates to a process for displaying measuring results in graphic form in a test apparatus for textile goods such as yarn, roving or sliver, in which a number of individual samples of a batch are tested in the form of a test series and at least a part of the measuring results is displayed in graphic form.

In textile laboratories, especially in spinning factories, spot checks are carried out to determine certain textile parameters such as fluctuations in mass, hairiness, tensile strength, fineness, and twist It is necessary on statistical grounds to test a relatively large number of individual samples from each batch to be tested. These samples are tested in the form of a test series which produces not only results which can be expressed in numerical data but also results which can only be fully expressed by graphs.

Examples of the latter include in particular a diagram showing fluctuations in mass along a tested textile sample, a spectrogram, a length variation curve, and a frequency diagram.

For the diagram of fluctuations in mass, a length scanned in a measuring instrument is kept as short as possible, for example 8 mm, but for reasons of statistical reliability the length of the random sample should be as great as possible. For advantageous operation of a test apparatus, therefore, the sample is drawn at high speed through a measuring instrument so that the mass fluctuations are obtained at relatively high frequencies in the test apparatus.

A spectrogram is a spectrum of wavelengths obtained in the diagram and is generally obtained by a Fourier analysis. The spectrogram gives important indications of the quality of the sample and of the cause of periodic or quasi-periodic faults.

The length variation curve gives the magnitude of the variation coefficient of the mass as a function of the scanning length and also provides information on the quality of the sample and the cause of faults.

Other graphic representations that are obtainable include, for example, line diagrams, force-elongation curves, and modulus-elongation curves.

Present-day computers are able to interpret the data extremely rapidly during the measuring time so that the measuring results can virtually be displayed at the end of the measuring process. Numerical values may be displayed by instruments with pointers or instruments with digital display, while graphs are usually displayed by means of plotters or chart recorders which produce the graphs on a suitable strip of paper.

Chart recorders have, however, numerous disadvantages. First, they are highly susceptible to failure because the pens tend to get blocked in the dusty air of textile laboratories; they are also difficult to operate. Second, their frequency response is very limited so that, for example, the amplitude of the diagrams that are produced decreases with increasing speed of testing.

Third, when a chart with a scale is required it is necessary to use special preprinted graph paper and in many cases the recording on the chart must be brought in line with the preprinted marks on the paper. Finally, since the charts obtained with chart recorders are produced in an abnormal format, they must be glued to paper of normal format before they can be filed away.

All of these disadvantages could be overcome by digitally storing the charts during the measuring time and subsequently printing them out on a chart printer, for example during the next measurement in the test series. Since, however, most chart printers are relatively slow the printing, for example of a diagram, a spectrogram or a length variation curve, takes up considerably more time than the next measurement. It follows that in a test series carried out on 10 or 20 random samples, a test apparatus cannot begin the measurement of, for example, the third sample until the printer has printed the results of the second sample, so that pauses occur between the individual measurements of a test series, with the result that the efficiency of the test apparatus is greatly reduced.

OBJECTS AND BRIEF STATEMENT OF THE INVENTION

It is thus an object of the present invention to provide a process of the type mentioned above which requires no chart recorder for graphic representation of the measuring results and in which no pauses which seriously reduce the efficiency of the test apparatus occur between the individual measurements of a test series.

To solve this problem according to the invention, at least one type of the graphically produced data for each individual sample of a test series is stored in digital form and is subsequently displayed in a collective chart with n suitably arranged individual graphs after n individual samples have been tested.

Since the time required for printing such a collective chart is not significantly greater than that required for printing an individual graph, the time required for printing the graphs of a test series is greatly reduced. If, for example, the diagram for mass fluctuations, the spectrogram and the length variation curve are to be displayed and the time required for printing an individual graph is t, then the time required for printing the graphs of n individual samples without the use of the collective chart according to the invention is 3nt. But this time is reduced to 2nt+t when one collective chart is issued and to nt+2nt when two collective charts are produced.

The invention further relates to an apparatus for carrying out the above-mentioned process using a test apparatus and a screen and/or printer capable of producing graphs and being activated by the test apparatus. The apparatus of the invention is characterized by a digital memory for storing rapidly produced data. The memory activates the printer and/or screen to display the stored data in graphic form.

BRIEF DESCRIPTION OF THE DRAWINGS

The invention will now be described with reference to an exemplary embodiment illustrated in the drawings, in which.

DETAILED DESCRIPTION OF THE DRAWINGS

Figure 1:
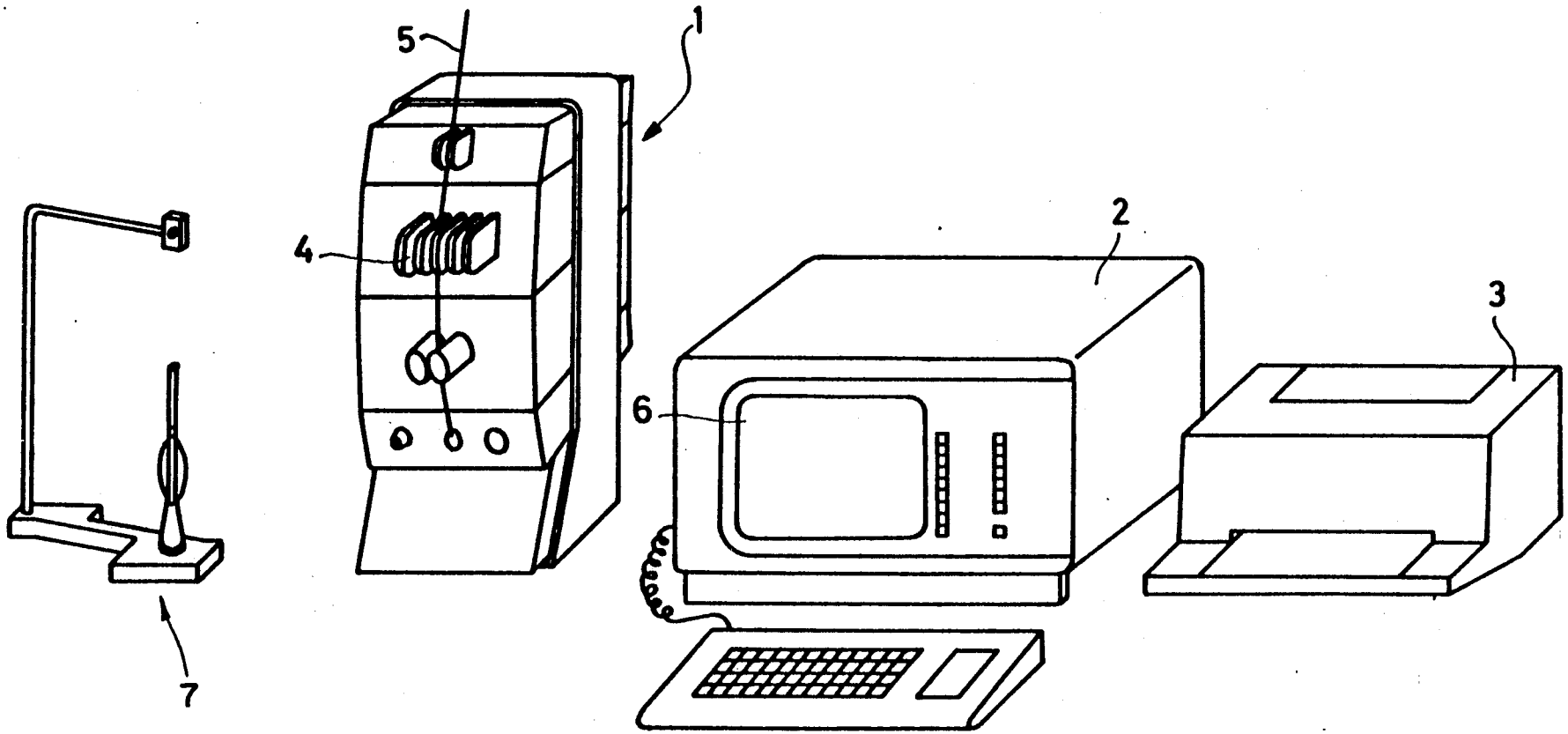
FIG. 1 is a perspective view of a uniformity tester for determining the fluctuations in mass of a textile material to be tested.

According to FIG. 1, a uniformity tester for determining mass fluctuations of textile material such as yarn, roving or sliver includes a test apparatus 1, an interpretation unit 2 and a printer 3. The test apparatus 1 has a measuring instrument 4 through which a material to be tested, indicated by the reference numeral 5, is drawn at a constant speed. A frame work 7 may be provided for holding packages, such as spools, of the test material 5. Electrical signals continuously produced by the measuring instrument 4 are processed by a calculator of the interpretation unit 2 and stored in some suitable form in a memory which is integrated with the interpretation unit 2. The test apparatus 1 is of a well-known kind and therefore not described here. See in this connection the uniformity tester USTER TESTER (USTER is a Registered Trademark of Zellweger Uster AG) marketed worldwide by the Assignee of the present Patent Application.

The interpretation unit 2 is preferably combined with a video screen 6 which by virtue of its inertia-free display action is most suitable for presenting data such as diagrams obtained from rapidly occurring processes. It is therefore advantageous first to display all data that is produced, such as numerical values and charts, on the screen 6. This display may in some cases be found to be sufficient and may later be deleted but, if desired, certain figures and charts may be selected to be subsequently printed in a suitable form on paper of standard format in the printer 3. The present state of the art enables the data to be printed not only in the form of the necessary graph but also together with a correctly labelled coordinate frame. This eliminates the need for expensive preprinting of recording paper and the complicated procedure of bringing the print-out into alignment with the marks on the paper. Results and graphs printed on paper of normal format can be filed away without any additional work such as pasting the recording paper on paper of normal format or labelling the results. The irksome need to handle plotters is eliminated and rapidly occurring processes are always printed with the same amplitude, regardless of the speed with which the material 5 to be tested is passed through the test apparatus 1.

Figure 2:
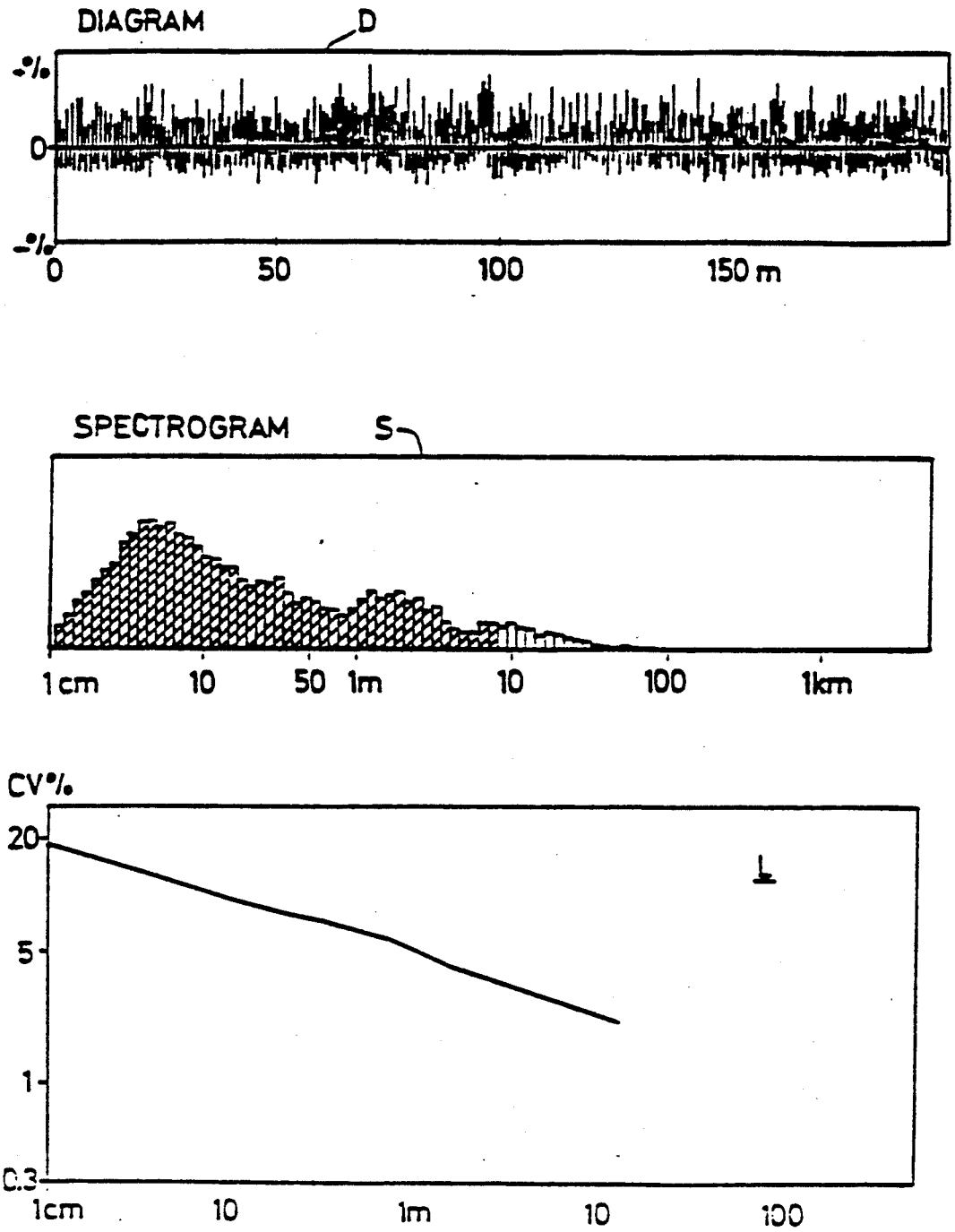
FIG. 2 shows, a diagram, a spectrogram and a length variation curve of an individual sample.

FIG. 2 shows at the top a diagram D of fluctuations in mass along the material 5 to be tested (Abscissa: Length of material in meters), in the middle a spectrogram S (Abscissa: Wavelength) and at the bottom a length variation graph L (Abscissa: Cut length) of a single sample. These graphic representations are also known from the USTER TESTER.

If a test series of several, for example 10, individual samples is carried out in the usual manner with the uniformity tester (FIG. 1), then the three charts shown in FIG. 2 are printed for each of the 10 samples. The only disadvantage of this arrangement is the relatively low printing speed of the printer 3. Although the printing speed has no effect on the accuracy of reproduction by virtue of the fact that the data is stored, the printing process takes up a considerable amount of time so that printing generally cannot be started until completion of the test process of which the results are to be printed.

This is no problem so long as the print process does not take longer than the time required for testing the next individual sample within a test series because, in that case, the measuring results of the mth individual sample are printed out while the m+1th sample is tested, etc. The number of individual tests that can be carried out per unit time is then determined solely by the testing time and not by the time required by the printer.

If, as in FIG. 2, more than one graph is printed for each individual sample, the time required for the printing process exceeds the time required for testing an individual sample. Moreover, several sensors may be arranged along the yarn so that not only the non-uniformity but in addition, for example, the fineness and hairiness can be tested in a single testing operation.

In such a case, additional charts must be printed as well as those shown in FIG. 2, and the printing time rapidly increases. As a result, pauses must be interposed after the individual tests to give the printer time to print the stored charts. The efficiency of the test installation then rapidly decreases.

When three charts are printed out in each individual test as shown in FIG. 2, the printing time is about twice the testing time and the efficiency of the test installation falls to about half owing to the time required for printing. The total length of the printed paper strip is proportional to the printing time since the print is produced line by line.

Figure 4:
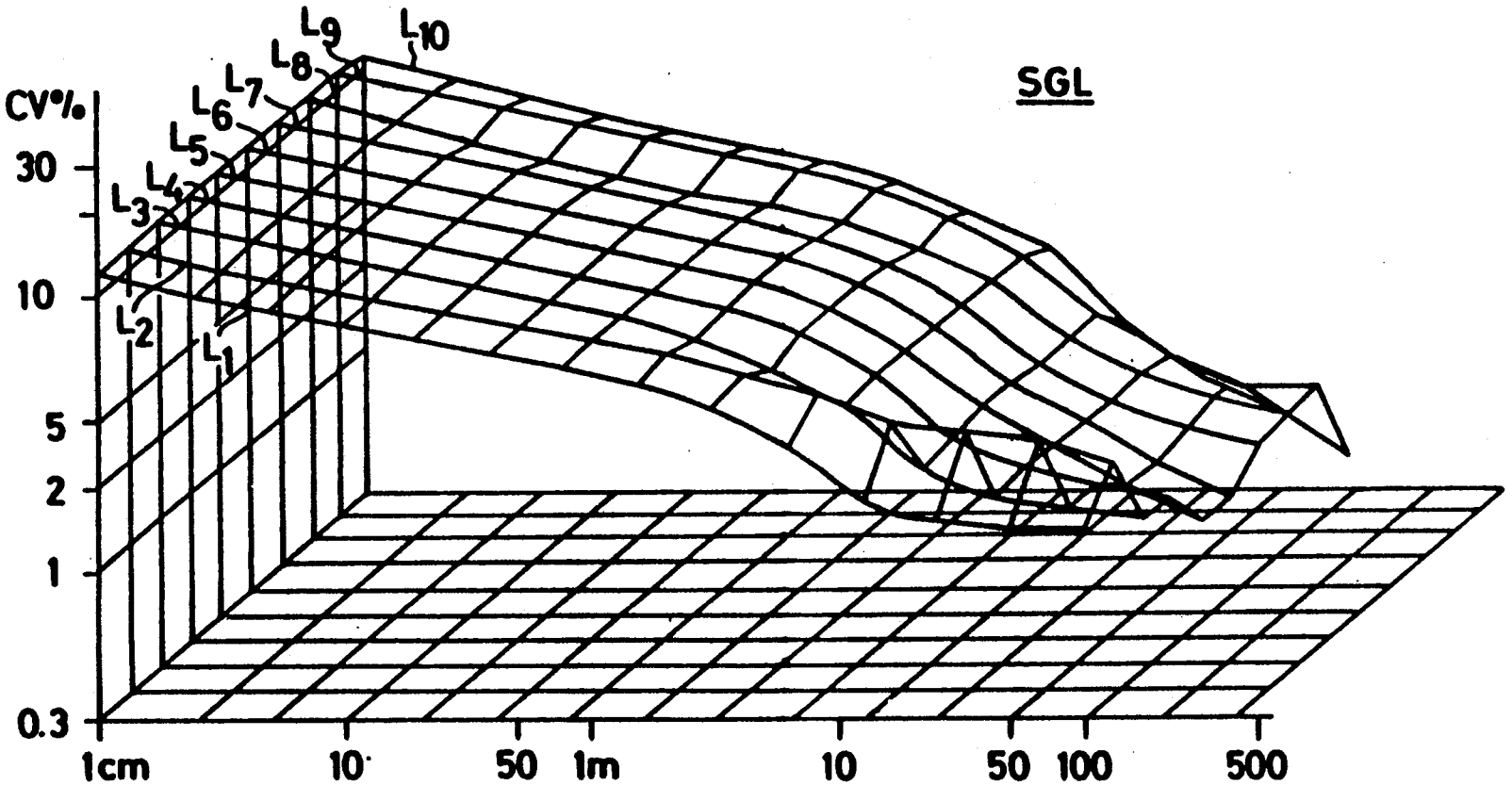
FIG. 4 shows a collective chart of 10 length variation curves.
Figure 3:
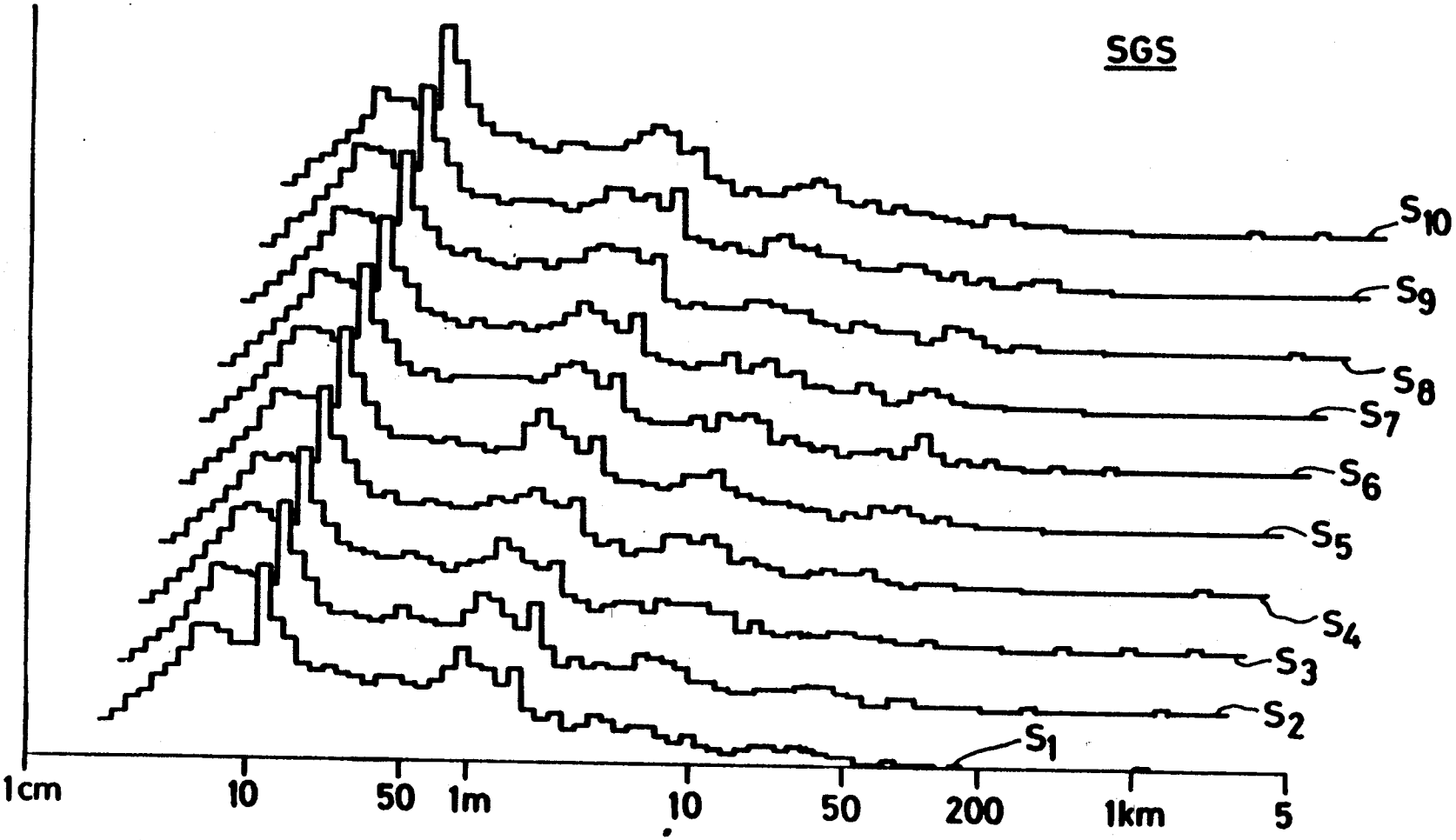
FIG. 3 shows a collective chart composed of 10 spectrograms.

In accordance with the present invention, the printing time may be drastically reduced by printing certain data in the form of a collective chart. FIG. 3 shows such a collective chart SGS containing 10 spectrograms $S_1$–$S_{10}$, and FIG. 4 shows a collective chart SGL containing 10 length variation curves $L_1$–$L_{10}$. If the time required for printing a single graph is t, then the time required for printing the individual graphs shown in FIG. 2 for 10 individual tests is $3\times 10t=30t$. This time, 30t, is reduced to about $20t+t=21t$ when one of the graphs is issued as part of a collective chart and to about $10t+2t=12t$ when two graphs are in collective charts.

Figure 5:
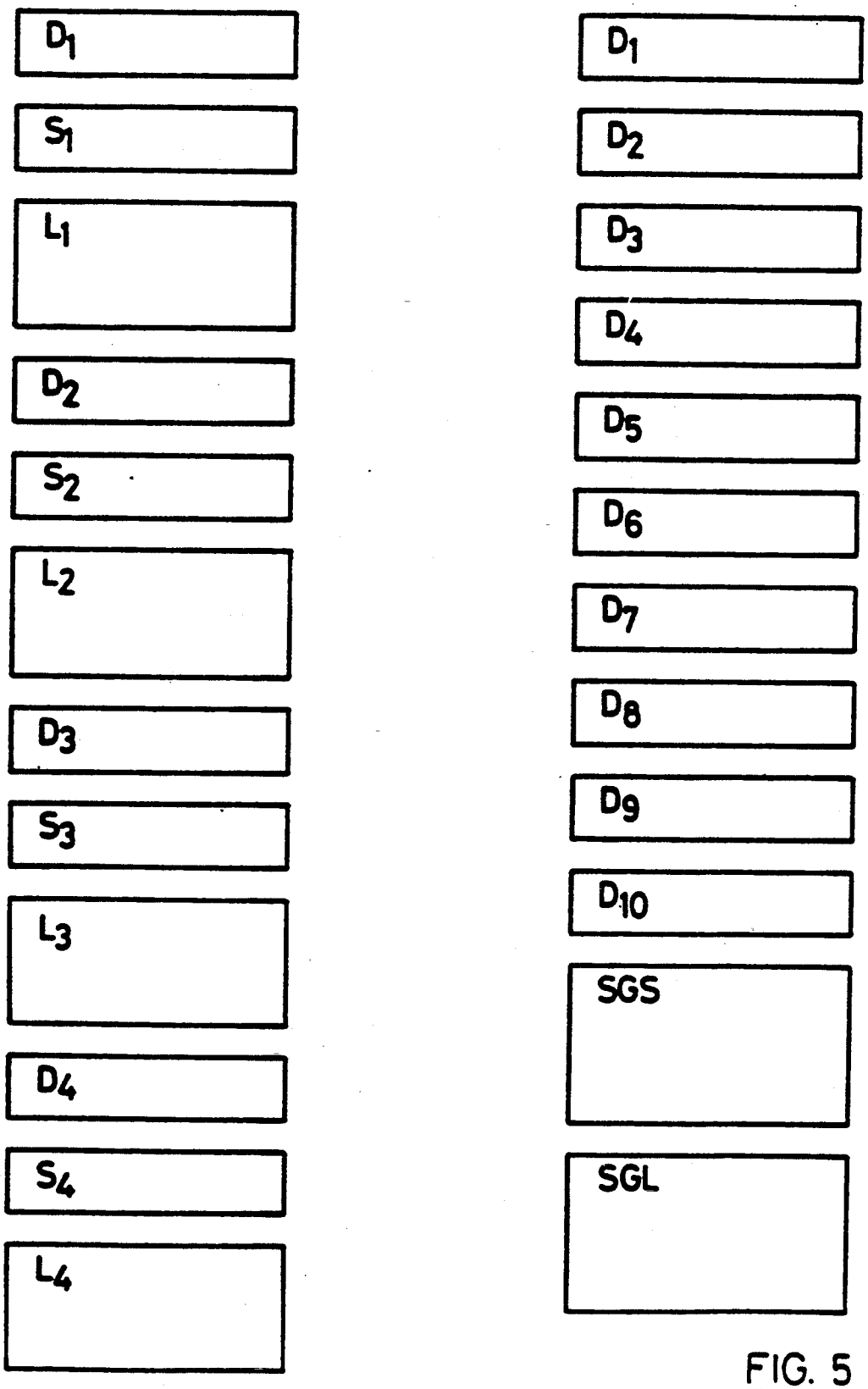
FIG. 5 represents a schematic comparison of the amount of paper required with and without the issue of collective charts.

If 10 diagrams $D_1$ to $D_{10}$ (as individual graphs) are printed for 10 individual tests, but one collective chart SGS is printed for the 10 spectrograms and one collective chart SGL for the 10 length variation curves, then, as shown in FIG. 5, the total length of paper strip is equal to that required for printing only individual graphs $D_1$ to $D_4$, $S_1$ to $S_4$, and $L_1$ to $L_4$ for four individual tests. This means that the printing time is reduced by 60%, which corresponds to the arithmetic assessment in the previous paragraph, so that the efficiency of the test installation is no longer reduced.

Collective charts SGS, SGL of the type shown in FIGS. 3 and 4 provide not only reduced time requirements but also other advantages. A test series is carried out within a given batch to be tested and if the batch is homogeneous then all the curves in the collective chart are identical. If individual curves are abnormal then this is immediately apparent, as can be seen, for example, in the case of curves L2, L8 and L9 in FIG. 4. Individual curves of this kind may then be recalled from the memory again at the end of the test series and analyzed and/or printed separately (selective report).

Various arrangements of curves may be used for collective charts.

All n curves of a collective chart may be written on top of one another. A tangle of closely packed curves is then obtained, the edges of which represent a measure of the greatest deviations occurring. This method has the disadvantage, however, that individual curves cannot be selected from this tangle and the sequence in which they have been printed is not recognizable.

Another possible method involves shifting each individual curve by a fixed but relatively small amount from the preceding curve in one direction. If deflections are large, however, the curves may becomes so intermingled that interpretation is difficult It would then be necessary to shift the curves from one another by such a large amount that the collective chart would become unacceptably large The most suitable method is found to be that employed in FIGS. 3 and 4, in which each curve is displaced from the preceding curve by a fixed amount in two directions, upwards and to the right. A three-dimensional effect is thereby produced which very considerably facilitates the interpretation of the results.

The fact that 10 curves are shown in the collective charts of FIGS. 3 and 4 is purely arbitrary and by way of example. The collective charts could, of course, contain more than, or fewer than, 10 curves. Moreover, collective charts could be used to display data other than those shown here; for example they could be used as histograms (frequency diagrams) of measured values. Lastly, it should be noted that the process described is, of course, suitable not only for test apparatus for textile materials to be tested but may be used in any test processes which yield measuring results which are to be issued graphically.

What is claimed is:

1. A method for testing rovings, yarns or slivers and providing a presentation of information indicating a quality of the tested material, comprising the steps of:

(a) running a sample roving, yarn or sliver lengthwise past a sensing head of a test apparatus, said sensing head being operative to produce signals indicating values along the length of said sample;

(b) analyzing variations caused in said sensing head signals when said sample roving, yarn or sliver moves lengthwise past said sensing head to produce a set of analytical quantities plottable as a graph;

(c) storing said set of analytical quantities in a memory;

(d) repeating steps (a)-(c) for a plurality of said samples and producing thereby sets of analytical quantities of the same type for all of said samples; and (e) presenting for each of the samples a graph of the same type from said set of analytical quantities for that respective sample, with said graphs being in proximity to one another and being shifted relative to one another to form a collective chart.

2. The method of claim 1, further including the subsequent steps of recalling said stored set of analytical quantities corresponding to a selected individual graph of said collective chart and presenting a display of said individual graph.

3. The method of claim 1, wherein said presenting step provides a vertical shift of said individual graphs relative to one another.

4. A method for testing rovings, yarns or slivers and providing a presentation of information indicating a quality of the tested material, comprising the steps of:

(a) running a sample roving, yarn or sliver lengthwise past a sensing head of a test apparatus, said sensing head being operative to produce signals indicating values along the length of said sample;

(b) analyzing variations caused in said sensing head signals when said sample roving, yarn or sliver moves lengthwise past said sensing head to produce a set of analytical quantities plottable as a graph;

(c) storing said set of analytical quantities in a memory;

(d) repeating steps (a)-(c) for a plurality of said samples; and (e) presenting, in the form of a collective chart, a graph for each of said sets of analytical quantities, while providing a vertical and horizontal shift of said individual graphs relative to one another to produce a three-dimensional effect.

5. The method of claim 4, further including the subsequent steps of recalling said stored set of analytical quantities corresponding to a selected individual graph of said collective chart and presenting a display of said individual graph.

6. The method of claim 4, wherein said analyzing step is carried out for each of said samples to produce a set of analytical quantities plottable as a graph representing a wavelength spectrum.

7. The method of claim 4, wherein said analyzing step is carried out for each of said samples to produce a set of analytical quantities plottable as a graph representing a length variation curve.

8. The method of claim 4, wherein said analyzing step is carried out for each of said samples to produce a set of analytical quantities plottable as a graph representing a histogram.

9. A method for testing a roving, yarn or sliver and providing a presentation of information indicating characteristics of said roving, yarn or sliver, comprising the steps of:

(a) feeding a sample of said roving, yarn or sliver to a test apparatus;

(b) running said sample of said roving, yarn or sliver lengthwise past a sensing head of said test apparatus;

(c) producing with said sensing head signals indicating a characteristic of said sample;

(d) determining from said sensing head signals a feature of said sample of roving, yarn or sliver;

(e) repeating steps (a) through (d) for a plurality of samples of said roving, yarn or sliver and producing thereby a determination of the same feature for all of said samples; and (f) presenting, in a common display, a graph of said feature for each of said plurality of samples of the roving, yarn or sliver, said graphs providing a collective chart having individual graphs of the same feature for all of said samples with said individual graphs being shifted relative to one another.

10. The method of claim 9, wherein said determining step produces a set of signals plottable as a graph of said feature of said sample, wherein one such set of signals is stored for each of said samples, and wherein said method further includes the subsequent step of recalling the set of signals for a selected individual graph from said collective chart and displaying said individual graph.

11. The method of claim 9, wherein said collective chart displays at least one of a wavelength spectrum, a length variation curve, and a histogram of relative fluctuations in said characteristic.

12. A method for testing a roving, yarn or sliver and providing a presentation of information indicating characteristics of said roving, yarn or sliver, comprising the steps of:

(a) feeding a sample of said roving, yarn or sliver to a test apparatus;

(b) running said sample of said roving, yarn or sliver lengthwise past a sensing head of said test apparatus;

(c) producing with said sensing head signals indicating a characteristic of said sample;

(d) determining from said sensing head signals a feature of said sample of roving, yarn or sliver;

(e) repeating steps (a) through (d) for a plurality of samples of said roving, yarn or sliver; and (f) presenting, in a common display, a graph of said feature for each of said plurality of samples of the roving, yarn or sliver, said graphs providing a collective chart in which there is a vertical and horizontal shift of said individual graphs relative to one another to produce a three-dimensional effect.

13. A test apparatus for testing a roving, yarn or sliver and providing a presentation of information indicating a quality of the tested material, comprising a sensing head and means for successively running a plurality of samples of the roving, yarn or sliver lengthwise past said sensing head, said sensing head being operative to produce signals indicating values along the length of said samples;

means for analyzing variations caused in said sensing head signals when each of said samples of roving, yarn or sliver moves lengthwise past said sensing head to produce for each individual sample a set of analytical quantities of the same type which is plottable as a graph representative of that individual sample;

memory means for storing said sets of analytical quantities; and means for presenting in the form of a collective chart, a graph for each of said sets of analytical quantities of the same type, with said graphs being shifted vertically and horizontally relative to one another.

14. A method for testing rovings, yarns or sliver and providing a presentation of information indicating a quality of the tested material, comprising the steps of:

running a plurality of sample rovings, yarns or slivers lengthwise past a measurement instrument, said measurement instrument being operative to produce signals indicating fluctuations in the same parameter along the lengths of said samples;

for each of said samples, processing said fluctuations in the same way to produce for each sample a set of results plottable as a graph of the same type, said type being selected from the group consisting of a spectrogram, a length variation graph and a histogram; and presenting for each of said samples a separate graph of the same type from said set of results for that respective sample, with said graphs being in proximity to one another and being shifted vertically and horizontally relative to one another to form a collective chart.

15. The method of claim 14, including a further step of storing said set of results for each sample prior to said presenting step.

16. A method for testing rovings, yarns or slivers and providing a presentation of information indicating a quality of the tested material, comprising the steps of:

running a plurality of sample rovings, yarns or slivers lengthwise past a measurement instrument, said measurement instrument being operative to produce signals indicating fluctuations in the same parameter along the lengths of said samples;

for each of said samples, processing said fluctuations in the same way to produce for each sample a set of results plottable as a graph of the same type, said type being selected from the group consisting of a spectrogram and a length variation graph; and presenting for each of said samples a separate graph of the same type from said set of results for that respective sample, with said graphs being in proximity to one another and being shifted vertically and horizontally relative to one another to form a collective chart.

17. The method of claim 16, including a further step of storing said set of results for each sample prior to said presenting step.

18. The method of claim 17, wherein said processing produces results plottable as a spectrogram for each of said samples.

19. The method of claim 17, wherein said processing produces results plottable as a length variation graph for each of said samples.

20. The method of claim 16, wherein said processing produces results plottable as a spectrogram for each of said samples.

21. The method of claim 16, wherein said processing produces results plottable as a length variation graph for each of said samples.

22. A method for testing rovings, yarns or slivers and providing a presentation of information indicating the quality of the test material, comprising the steps of:

running a plurality of samples of a roving, yarn or sliver lengthwise past a sensing head, said sensing head being operative to produce signals indicating values of at least one of mass and hairiness along the length of each of said samples, determining from said sensing head signals variations of said values for each said sample;

processing said variations to obtain a wavelength spectrum of said variations for each sample;

presenting, in the form of a collective chart, a graph of said wavelength spectrum for each of said samples, said graphs being shifted vertically relative to one another.

23. A method for testing rovings, yarns or slivers and providing a presentation of information indicating the quality of the test material, comprising the steps of:

running a plurality of samples of a roving, yarn or sliver lengthwise past a sensing head of a test apparatus, said sensing head being operative to produce signals indicating values of at least one of mass and hairiness along the length of each said sample;

determining from said sensing head signals a coefficient of variation for each of a plurality of different test lengths of each said sample;

presenting, in the form of a collective chart, a graph of said coefficients of variation versus test length for each of said samples, said graphs being shifted vertically relative to one another.

24. A method for testing rovings, yarns or slivers and providing a presentation of information indicating a quality of the tested material, comprising the steps of:

running a plurality of samples of roving, yarn or sliver lengthwise past a measurement instrument and causing the production of signals indicating fluctuations in the same parameter along the lengths of the respective samples;

for each of said samples, deriving from said signals indicating fluctuations a first set of quantities plottable as a curve and being indicative of a characteristic of the respective sample at successive points along its length;

for each of said samples, processing in the same way signals indicating fluctuations to produce for each sample a second set of quantities analytically different than said first set of quantities, said second sets of quantities for all said samples being of the same type and being plottable as curves of the same type;

presenting, in the form of an individual chart, a curve for each of said second sets of analytical quantities; and presenting, in the form of a collective chart, a curve of the same type from each of said second sets of quantities, with said curves of said collective chart being in proximity to one another and being shifted vertically and horizontally relative to one another.

* * * * *

US005146550B1

REEXAMINATION CERTIFICATE (2784th)

United States Patent [19]

[11] B1 5,146,550

Furter et al.

[45] Certificate Issued Jan. 23, 1996

[54] PROCESS FOR DISPLAYING MEASURING RESULTS IN GRAPHIC FORM IN TEST APPARATUS FOR TESTING TEXTILE GOODS AND APPARATUS FOR CARRYING OUT THE PROCESS

[75] Inventors: Richard Furter, Zug; Benno Christen, Winterthur, both of Switzerland

[73] Assignee: Zellweger Uster Ltd., Uster, Switzerland

Reexamination Request:
No. 90/003,507, Jul. 25, 1994

Reexamination Certificate for:

| | |
|---|---|
| Patent No.: | **5,146,550** |
| Issued: | **Sep. 8, 1992** |
| Appl. No.: | **731,266** |
| Filed: | **Jul. 17, 1991** |

Related U.S. Application Data

[63] Continuation of Ser. No. 52,410, May 21, 1987, abandoned.

[30] Foreign Application Priority Data

May 21, 1986 [CH] Switzerland ..... 02043/86

[51] Int. Cl.[6] ..... G06F 17/60; G06F 19/00

[52] U.S. Cl. ..... 395/140; 364/470; 364/552; 73/160

[58] Field of Search ..... 395/140, 161, 395/119; 364/470, 552, 554, 563, 469; 73/160, 159; 340/677

[56] References Cited

U.S. PATENT DOCUMENTS

| | | | |
|---|---|---|---|
| 4,430,720 | 2/1984 | Aemmer | 364/552 |
| 4,481,820 | 11/1984 | Thomann | 73/160 X |
| 4,491,831 | 1/1985 | Sakai et al. | 340/677 |
| 4,537,202 | 8/1985 | Mancini et al. | 128/712 |
| 4,648,054 | 3/1987 | Farah et al. | 364/552 |
| 4,758,968 | 7/1988 | Lord | 364/552 |

FOREIGN PATENT DOCUMENTS

| | | |
|---|---|---|
| 97045 | 6/1984 | Japan . |
| 36912 | 2/1985 | Japan . |
| 209112 | 10/1985 | Japan . |

OTHER PUBLICATIONS

Leifeld, "Test Methods for Evenness Measurement of Card Webs", International Textile Bulletin Yarn Forming, Jan. 1986.

Farrar et al., *Pulse and Fourier Transform NMR Introduction to Theory and Methods*, Academic Press, 1971, p. 107.

"Uster Tester I Model B" Information Brochure PE452, 1980.

"Uster News Bulletin", Customer Information Brochure No. 28, Jul. 1980.

Furter, "Strength and Elongation Testing of Single and Ply Yarns", Textile Institute, 1985.

Stein, "Rechnergesteuerte Zugprüfgeräte", Textilpraxis International, Jan. 1984, pp. 38–40.

"Qualitätskontrolle/Etikettierung", Mittex, Jul. 1984, pp. 259–262.

"Keisokki Report", No. 2, Sep. 1985.

"Keisokki Report", ITMA 83 Issue, Oct. 1983.

*Primary Examiner*—Raymond J. Bayerl

[57] ABSTRACT

A number of individual samples from a batch of textile material are tested in the form of a test series. During each test series, at least one type of data obtained for each individual sample is stored digitally, and after n individual samples have been tested this data is displayed in the form of a collective chart containing n suitably arranged individual curves. This type of display does away with the use of a chart recorder with its known disadvantages and enables a printer to be used. Also, since the data can be displayed in the form of a collective chart, pauses between individual measurements, which would otherwise occur due to the relatively low printing speed of the printer, and which would greatly reduce the output of the test installation, do not occur.

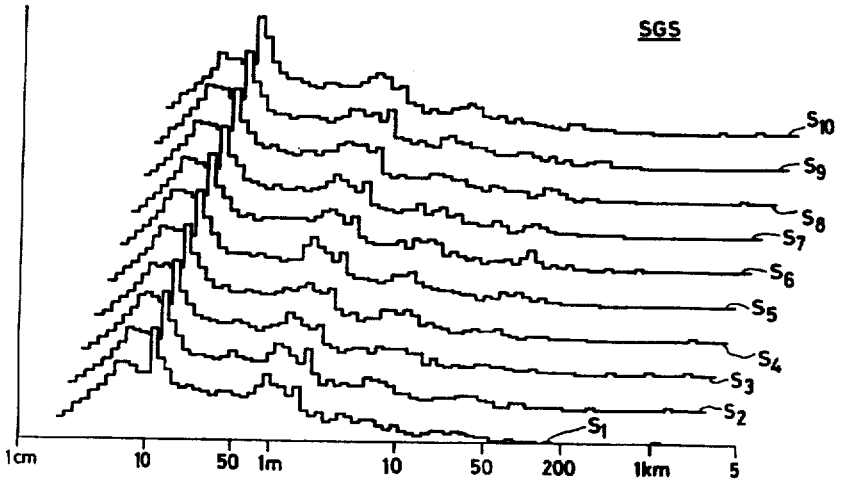

REEXAMINATION CERTIFICATE ISSUED UNDER 35 U.S.C. 307

NO AMENDMENTS HAVE BEEN MADE TO THE PATENT.

AS A RESULT OF REEXAMINATION, IT HAS BEEN DETERMINED THAT:

The patentability of claims 1–24 is confirmed.

* * * * *